US007224926B2

(12) United States Patent
Toba et al.

(10) Patent No.: US 7,224,926 B2
(45) Date of Patent: May 29, 2007

(54) FLIGHT DEVELOPER REGULATING MEMBER, DEVELOPING APPARATUS AND METHOD OF ASSEMBLING DEVELOPING APPARATUS

(75) Inventors: Shinjiro Toba, Odawara (JP); Masaki Kakitani, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 140 days.

(21) Appl. No.: 11/091,587

(22) Filed: Mar. 29, 2005

(65) Prior Publication Data

US 2005/0220501 A1 Oct. 6, 2005

(30) Foreign Application Priority Data

Mar. 31, 2004 (JP) ..... 2004-104633
Mar. 14, 2005 (JP) ..... 2005-071278

(51) Int. Cl.
*G03G 15/08* (2006.01)

(52) U.S. Cl. ..... 399/284; 399/274; 399/279; 399/285

(58) Field of Classification Search ..... 399/279, 399/285, 274, 284, 98
See application file for complete search history.

(56) References Cited

U.S. PATENT DOCUMENTS 4,928,145 A * 5/1990 Okamoto et al. ..... 399/272
5,576,813 A * 11/1996 Toyama et al. ..... 399/274
5,689,784 A * 11/1997 Shin et al. ..... 399/285
6,151,465 A 11/2000 Toba et al. ..... 399/90
6,473,578 B2 10/2002 Miyabe et al. ..... 399/119
6,708,010 B2 3/2004 Miyabe et al. ..... 399/104
6,941,097 B2 9/2005 Toba et al. ..... 399/227
2002/0197086 A1* 12/2002 Ishibashi et al. ..... 399/274
2003/0021614 A1* 1/2003 Takeuchi et al. ..... 399/267
2003/0059228 A1* 3/2003 Tatsumi ..... 399/274
2005/0008401 A1 1/2005 Kawamura et al. ..... 399/265

FOREIGN PATENT DOCUMENTS

JP 8-22185 1/1996
JP 08-95373 4/1996

* cited by examiner

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

A developing apparatus including a developer carrying member, a developer layer regulating member and a flight developer regulating member, wherein the developer carrying member is provided in opposed relationship with an image bearing member and carries a developer thereon, and in an opposed portion between the image bearing member and the developer carrying member, an oscillating electric field is formed between the image bearing member and the developer carrying member, and the developer is caused to fly from the developer carrying member to the image bearing member, and the developer layer regulating member regulates a layer of developer on the developer carrying member, and the flight developer regulating member is mounted on the developer layer regulating member, and regulates an area in which the developer flies in the opposed portion.

20 Claims, 12 Drawing Sheets

FLIGHT DEVELOPER REGULATING MEMBER, DEVELOPING APPARATUS AND METHOD OF ASSEMBLING DEVELOPING APPARATUS

BACKGROUND OF THE INVENTION

1. Field of the Invention

The invention relates to a flight developer regulating member, a developing apparatus and a method of assembling a developing apparatus preferably used in an image forming apparatus of an electrophotographic type or an electrostatic recording type.

2. Related Background Art

There has heretofore been adopted a process cartridge method whereby an electrophotographic photosensitive member, charging means, developing means, cleaning means, etc. are integrally made into a cartridge, which is made detachably mountable on an image forming apparatus main body. By this cartridge method, operability is more improved and it becomes possible for a user himself to easily effect the maintenance of the above-mentioned process means and therefore, this cartridge method is widely used in image forming apparatuses of the electrophotographic type.

As a developing method in such a process cartridge, there is a developing method whereby a developer carrying member and an image bearing member are in non-contact with each other and an AC electric field (oscillating electric field) is given to between the two to thereby effect developing. This method causes a developer flying from the developer carrying member to adhere to an electrostatic latent image formed on the image bearing member to thereby effect developing. In a case where the developer is thus caused to fly from the developer carrying member to the image bearing member, there has arisen the problem that even if a latent image which should be equal in density is formed on the moving image bearing member, more developer adheres to the rear end portion of the latent image. Thus, the density sometimes becomes high only on the rear end of the image, and in order to cope with a desire for a high quality of image required in recent years, a further improvement has come to be desired.

To solve this, there is known a method of providing a plate-shaped member in a developing area as shown in Japanese Patent Application Laid-Open No. H08-22185.

The plate-shaped member, however, is disposed in a minute interstice between the developer carrying member and the image bearing member and therefore, the fore end thereof must be attached with high accuracy, and this has led to the problem that much time is required for assembly, and a further improvement has been necessary.

SUMMARY OF THE INVENTION

It is an object of the present invention to provide a flight developer regulating member, a developing apparatus and a method of assembling a developing apparatus which regulate an area for a developer flying in the gap between an image bearing member and a developer carrying member.

It is another object of the present invention to provide a flight developer regulating member, a developing apparatus and a method of assembling a developing apparatus which prevent any density change from occurring to an image which should be equal in image density.

It is another object of the present invention to provide a flight developer regulating member, a developing apparatus and a method of assembling a developing apparatus which suppress the phenomenon that image density becomes high in the trailing edge portion of an image.

It is another object of the present invention to provide a flight developer regulating member which can be highly accurately and simply attached to a developing apparatus, a developing apparatus and a method of assembling a developing apparatus.

It is another object of the present invention to provide a flight developer regulating member, a developing apparatus and a method of assembling a developing apparatus which can improve the assembling property of the flight developer regulating member and the developing apparatus.

Further objects and features of the present invention will become more apparent from the following detailed description when read with reference to the accompanying drawings.

DESCRIPTION OF THE PREFERRED EMBODIMENTS

Some embodiments of the present invention will be described with reference to the drawings.

An embodiment of a multi-color image forming apparatus which can use the developing apparatus of the present invention will first be described in detail with reference to the drawings.

<General Construction of the Multi-Color Image Forming Apparatus>

Figure 3:
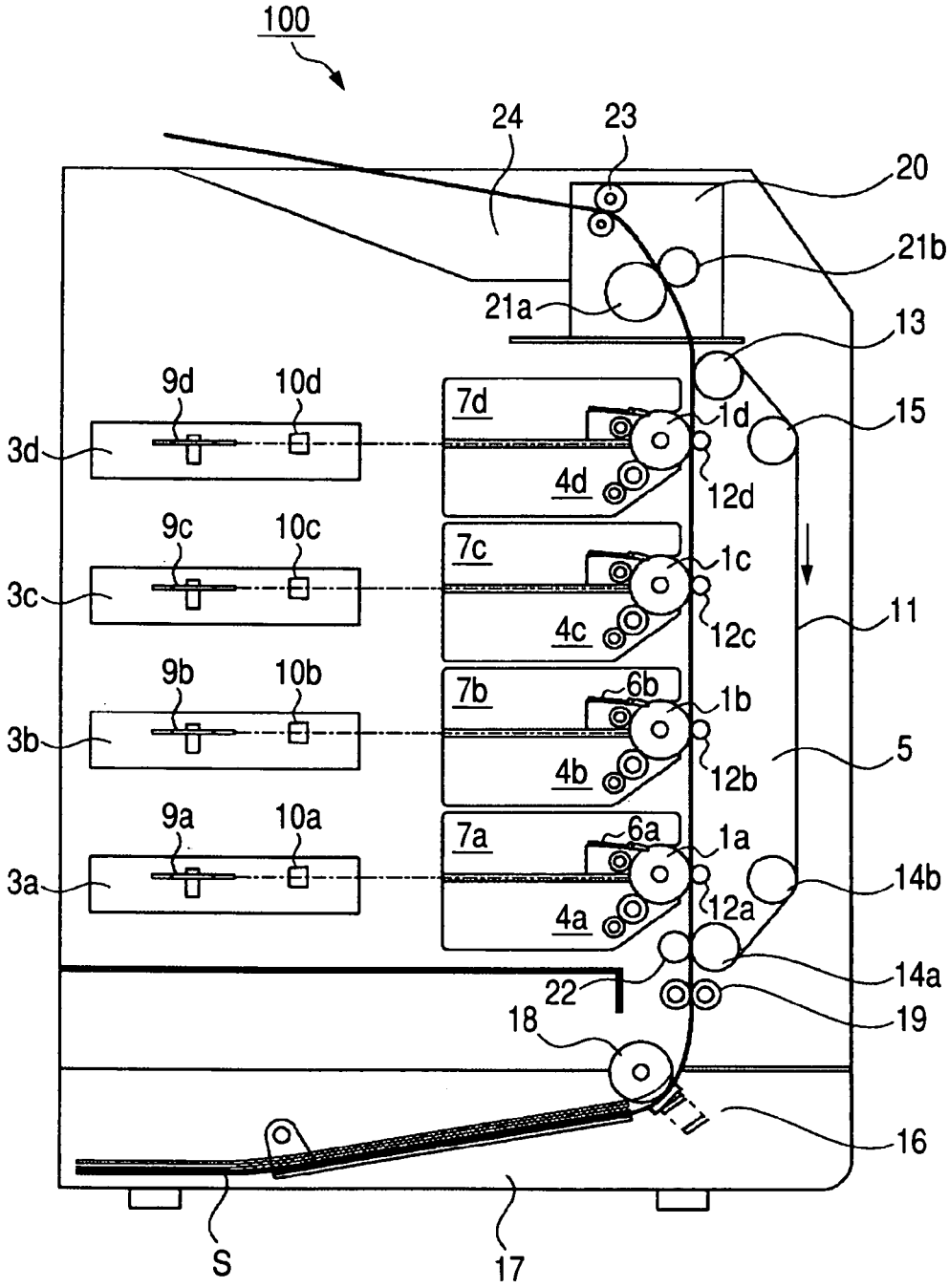
FIG. 3 is a cross-sectional view showing a process cartridge according to the present invention.

The general construction of the multi-color image forming apparatus will first be schematically described with reference to FIG. 3. FIG. 3 is a longitudinal cross-sectional view showing the general construction of a full-color laser beam printer 100 which is an embodiment of the multi-color image forming apparatus.

The multi-color image forming apparatus 100 shown in FIG. 3 is provided with photosensitive drums 1*a*, 1*b*, 1*c* and 1*d* which are four image bearing members juxtaposed in a vertical direction. Each photosensitive drum 1 is rotatively driven in a counter-clockwise direction in FIG. 3 by driving means (not shown). Around the photosensitive drum 1, there are disposed a charging device 2 (2*a*, 2*b*, 2*c*, 2*d*) which is charging means for uniformly charging the surface of the photosensitive drum 1, a scanner unit 3 (3*a*, 3*b*, 3*c*, 3*d*) for applying a laser beam on the basis of image information to thereby form an electrostatic latent image on the photosensitive drum 1, a developing apparatus 4 (4*a*, 4*b*, 4*c*, 4*d*) which is developing means for causing a toner which is a developer to adhere to the electrostatic latent image to thereby develop the latent image as a toner image, an electrostatic transferring device 5 for transferring the toner image on the photosensitive drum 1 to a transfer material S, a cleaning device 6 (6*a*, 6*b*, 6*c*, 6*d*) which is cleaning means for removing any untransferred toner residual on the surface of the photosensitive drum 1 after the transfer, etc. in the named order in the rotational direction of the photosensitive drum 1.

Figure 4:
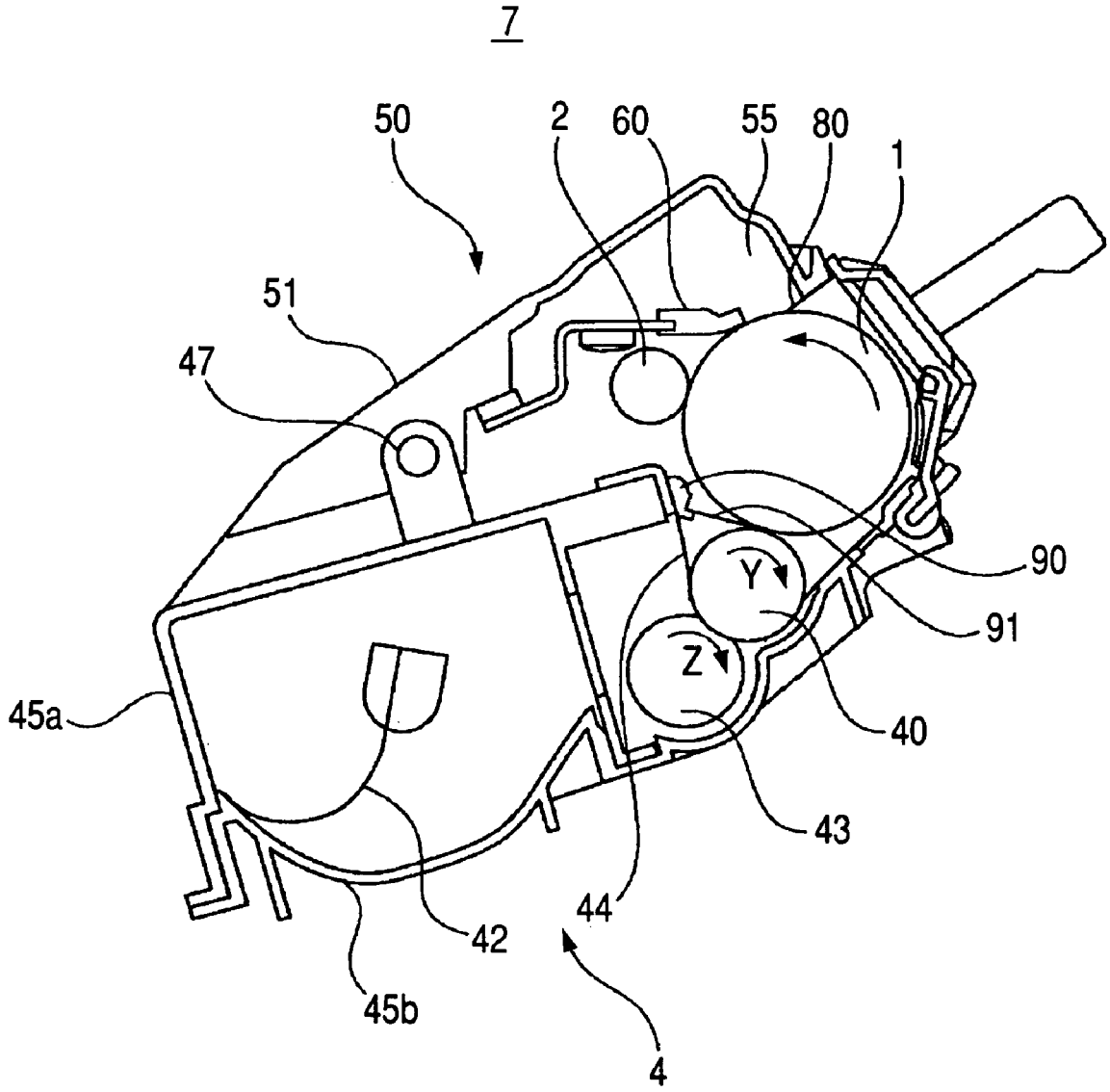
FIG. 4 is a cross-sectional view showing the process cartridge according to the present invention.
Figure 5A:
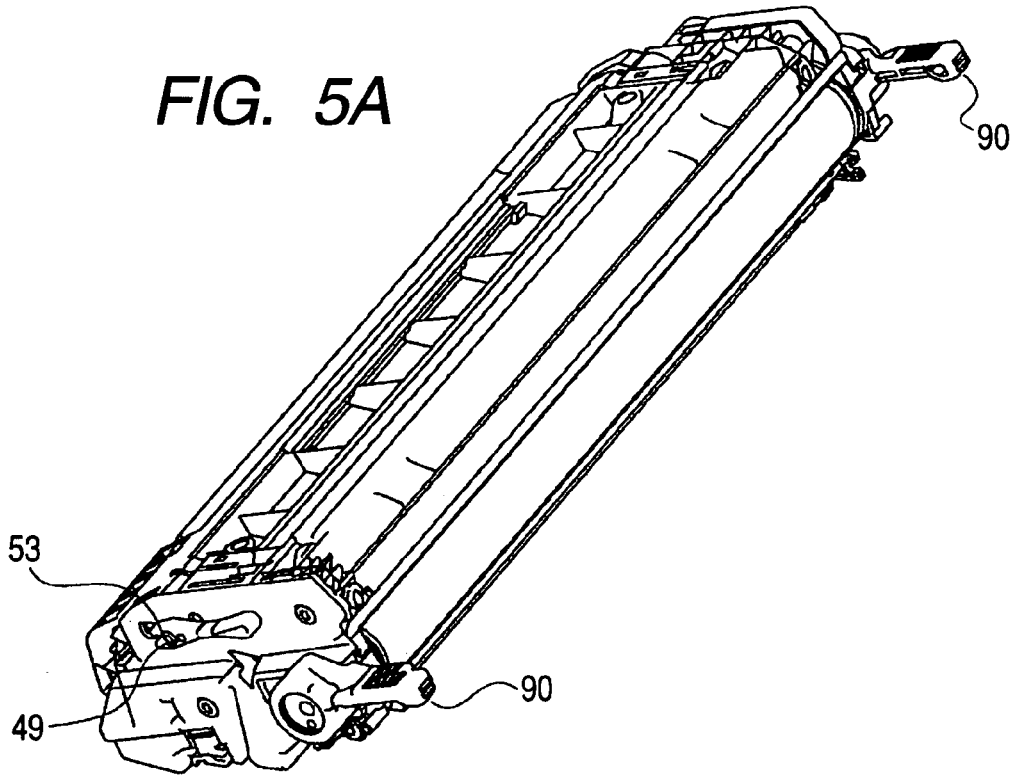
FIGS. 5A and 5B are perspective views showing the process cartridge according to the present invention.
Figure 5B:
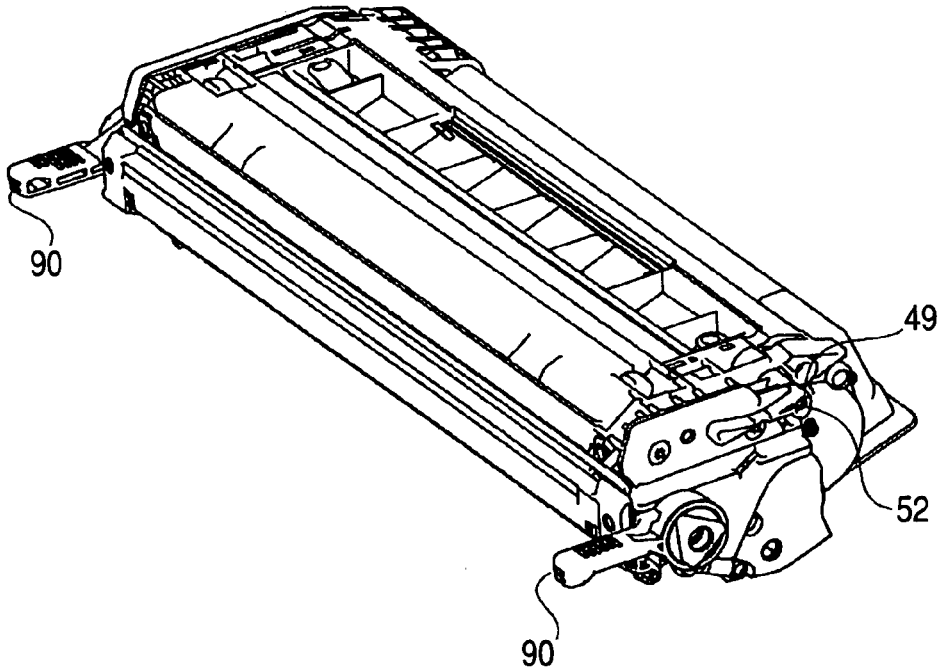

Here, as shown in FIG. 4, the photosensitive drum 1, the charging device 2, the developing apparatus 4 and the cleaning device 6 are integrally made into a cartridge, and a process cartridge 7 is formed for each color.

Detailed description will hereinafter be made of in succession from the photosensitive drum 1.

The photosensitive drum 1 is constituted by providing a photosensitive layer on the outer peripheral surface of e.g. an aluminum cylinder having a diameter of 24 mm. The photosensitive drum 1 has its opposite end portions rotatably supported by supporting members, and a driving force is transmitted from a drive motor (not shown) to one end portion thereof, whereby the photosensitive drum is rotatively driven in a counter-clockwise direction.

As the charging device 2, use can be made of one of a contact charging type. A charging member is an electrically conductive roller formed into a roller shape, and this roller is brought into contact with the surface of the photosensitive drum 1 and a bias voltage is applied to this roller to thereby uniformly charge the surface of the photosensitive drum 1. In the present embodiment, use is made of a reversal developing system, and the surface of the photosensitive drum 1 is charged to the minus polarity.

The scanner unit 3 is such that by a laser diode (not shown), image light corresponding to an image signal is applied to a polygon mirror 9 (9*a*, 9*b*, 9*c*, 9*d*) rotated at a high speed by a scanner motor (not shown). Design is made such that the charged surface of the photosensitive drum 1 is selectively exposed to the image light reflected by the polygon mirror through an imaging lens 10 (10*a*, 10*b*, 10*c*, 10*d*) to thereby form an electrostatic latent image.

The developing apparatus 4 is provided with toner containing portions containing yellow, magenta, cyan and black toners, respectively, therein, and feeds the toners in a developing container unit 4 which is the developing apparatus onto a toner supplying roller 43 by a feeding mechanism 42.

The toner supplying roller 43 is rotated in a clockwise direction Z as viewed in FIG. 4, and effects the supply of the toner to a developing sleeve 40 which is a developer carrying member, and the stripping of the toners after the developing on the photosensitive drum 1 has been effected from the developing sleeve 40. The developing sleeve 40 is of the shape of a hollow cylinder formed of aluminum or the like.

The toner supplied to the developing sleeve 40 is applied to the outer periphery of the developing sleeve 40 rotated in the clockwise direction as viewed in FIG. 4 by a developing blade 44 which is a developer layer regulating member brought into pressure contact with the outer periphery of the developing sleeve 40, and have minus charges imparted thereto. The developing blade 44 regulates the thickness of the developer layer on the developing sleeve 40.

A developing bias is then applied to the developing sleeve 40 opposed to the photosensitive drum 1 on which the latent image has been formed, whereby the latent image on the photosensitive drum 1 is developed. In the present embodiment, use is made of a reversal developing process in which the charging polarity of the photosensitive drum 1 and the charging polarity of the toners are the same.

The electrostatic transferring device 5 has disposed therein an electrostatic conveying belt 11 opposed to all the photosensitive drum 1*a*, 1*b*, 1*c*, 1*d* and circulatively moved so as to contact therewith. As the electrostatic conveying belt 11, use is made of resin film or a multi-layer film-like member comprising a rubber base layer and a resin layer provided thereon. This electrostatic conveying belt 11 is passed over a drive roller 13, driven rollers 14*a*, 14*a* and a tension roller 15, and is circulatively moved so as to electrostatically attract the transfer material S to the left outer peripheral surface thereof as viewed in FIG. 3 and bring the transfer material S into contact with the photosensitive drum 1. Thereby, the transfer material S is conveyed to a transferring position by the electrostatic conveying belt 11 and has the toner image on the photosensitive drum 1 transferred thereto.

Transfer rollers 12 (12*a*, 12*b*, 12*c*, 12*d*) are juxtaposed at positions in contact with the inside of this electrostatic conveying belt 11 and opposed to the four photosensitive drums 1*a*, 1*b*, 1*c*, 1*d*. A bias of the plus polarity is applied to these transfer rollers 12 during transfer, and charges of the plus polarity are applied to the transfer material S through the electrostatic conveying belt 11. By an electric field produced at this time, the toner image of the minus polarity on the photosensitive drum 1 is transferred to the transfer material S which is in contact with the photosensitive drum 1.

A sheet feeding portion 16 serves to feed and convey the transfer material S to an image forming portion, and a plurality of transfer materials S are contained in a sheet supplying cassette 17. During image formation, a sheet feeding roller 18 (halfmoon-shaped roller) 18 and registration rollers 19 are rotatively driven in conformity with an image forming operation to thereby separate and feed a sheet of transfer material S in the sheet supplying cassette 17, and the leading edge of the transfer material S strikes against the registration rollers 19 and the transfer material S is once stopped thereby and forms a loop, whereafter it is fed to the electrostatic conveying belt 11 by the registration rollers 19 in synchronism with the rotation of the electrostatic conveying belt 11 for an image writing-out start position.

A fixing portion 20 serves to fix the toner images of plural colors transferred to the transfer material S, and comprises a rotated heating roller 21*a* and a pressure roller 21*b* brought into pressure contact therewith for applying heat and pressure to the transfer material S.

That is, the transfer material S to which the toner images on the photosensitive drums 1 have been transferred is conveyed by the pressure roller 21*b* and is given heat and pressure by the heating roller 21*a* when it passes through the fixing portion 20. Thereby, the toner images of plural colors are fixed on the surface of the transfer material S.

As the image forming operation, the process cartridges 7*a*, 7*b*, 7*c*, 7*d* are successively driven by the main body of the image forming apparatus in timed relationship with printing, and in conformity with the driving, the photosensitive drums 1*a*, 1*b*, 1*c*, 1*d* are rotatively driven in a counter-clockwise direction as viewed in FIG. 3. The scanner units 3 corresponding to the respective process cartridges 7 are then successively driven. By this driving, the charging roller 2 imparts uniform charges to the peripheral surface of the photosensitive drum 1, and the scanner unit 3 effects exposure on the peripheral surface of the photosensitive drum 1 in conformity with an image signal to thereby form an electrostatic latent image on the peripheral surface of the photosensitive drum 1. The developing sleeve 40 in the developing apparatus 4 causes the toner to shift to the low potential portion (light portion) of the electrostatic latent image to thereby form (develop) a toner image on the peripheral surface of the photosensitive drum 1.

At the timing whereat the leading edge of the toner image of the photosensitive drum 1 which is most upstream with respect to the electrostatic conveying belt 11 is rotatively conveyed to a point opposed to the electrostatic conveying belt 11, the registration rollers 19 start rotation and feed the transfer material S to the electrostatic conveying belt 11 so that the printing start position of the transfer material S may coincide with the opposed point.

Design is made such that the transfer material S is brought into pressure contact with the outer periphery of the electrostatic conveying belt 11 in such a manner as to be nipped between an electrostatic attracting roller 22 and the electrostatic conveying belt 11, and a voltage is applied to between the electrostatic conveying belt 11 and the electrostatic attracting roller 22 to thereby induce charges in the dielectric material layer of the transfer material S and the electrostatic conveying belt 11 which are dielectric materials, and electrostatically attract the transfer material to the outer periphery of the electrostatic conveying belt 11. Thereby, the transfer material S is stably attracted to the electrostatic conveying belt 11 and is conveyed to the transferring portion most downstream with respect to the movement direction of the electrostatic conveying belt 11.

The transfer material S has the toner images on the respective photosensitive drums 1 successively transferred thereto by an electric field formed between the respective photosensitive drums 1 and the transfer rollers 12 while being thus conveyed.

The transfer material S to which the toner images of four colors have been transferred is curvature-separated (self-stripped) from the electrostatic conveying belt 11 by the curvature of the belt driving roller 13 and is conveyed into the fixing portion 20. The transfer material S has the toner images thereon heat-fixed by the fixing portion 20, and thereafter is discharged from a sheet discharging portion 24 to the outside of the main body by discharge rollers 23 with its image surface facing down.

<Construction of the Process Cartridge>

The process cartridge according to the present embodiment will now be described in detail with reference to FIGS. 4, 5A, 5B and 6. FIGS. 4, 5A, 5B and 6 show the main cross section and perspective views of the process cartridge 7 containing the toner therein. The yellow, magenta, cyan and black process cartridges 7*a*, 7*b*, 7*c* and 7*d* are of the same construction.

The process cartridge 7 is divided into the electrophotographic photosensitive drum 1 which is an image bearing member, a cleaner unit 50 provided with charging means and cleaning means, and the developing unit 4 having developing means for developing the electrostatic latent image on the photosensitive drum 1. The process cartridge 7 can be provided with at least one of the charging means, the developing means and the cleaning means, and the photosensitive drum 1.

The cleaner unit 50 of FIG. 4 is such that the photosensitive drum 1 is rotatably mounted on a cleaning frame member 51 through a bearing member. On the periphery of the photosensitive drum 1, there are disposed in contact therewith the charging roller 2 for uniformly charging the photosensitive layer provided on the outer periphery of the photosensitive drum 1, and a cleaning blade 60 and a flexible sheet member 80 for removing any developer (residual developer) residual on the photosensitive drum 1 after transfer. The residual toner (waste toner) removed from the surface of the photosensitive drum 1 by the cleaning blade 60 is contained in a waste toner chamber 55 provided rearwardly of the cleaning frame member. Also, the untransferred residual toner on the drum passes through that portion of the flexible sheet member 80 which is contact with the drum and arrives at the position of the cleaning blade 60, and the contact condition of the flexible sheet member 80 with the drum is set so that the residual toner removed from the drum by the cleaning blade 60 may not leak to the outside of the cleaning frame member 51.

The developing unit 4 is provided with the developing sleeve 40 keeping a minute gap between it and the photosensitive drum 1 and rotated in the direction of arrow Y, and developing frame members 45*a* and 45*b* constituting a toner containing portion containing the toner therein.

The developing frame members 45*a* and 45*b* are coupled together (coupled together by ultrasonic welding or the like) to thereby provide the developing container unit 4.

The developing sleeve 40 is rotatably supported in the developing container unit 4 through a bearing member, and a toner supplying roller 43 rotated in the direction of arrow Z and the developing blade 44 are disposed on and in contact with the periphery of the developing sleeve 40. Further, in the developing container unit 4, there is provided a toner conveying mechanism 42 for agitating the toner contained in the developing container unit 4 and conveying it to the toner supplying roller 43.

The developing container unit 4 is of suspended structure in which the entire developing unit 4 is supported for rocking movement relative to the cleaner unit 50 by coupling holes 47 formed in the end portions of the developing container unit 4 and supporting holes 52 and 53 (see FIGS. 5A and 5B) formed in the opposite ends of the cleaning frame member 51 of the cleaner unit 50 being aligned with each other, and a pin 49 being inserted thereinto from the opposite ends of the cleaner unit 50.

Also, the developing unit 4 is always biased by a pressure spring so that the developing sleeve 40 may go toward the photosensitive drum 1 about a supporting hole (not shown). During development, the toner contained in the toner containing portion is carried to the toner supplying roller 43 by the toner agitating mechanism 42. The toner supplying roller 43 rotated in the direction of arrow Y supplies the toner to the developing sleeve 40 by the frictional contact thereof with the developing sleeve 40 rotated in the direction of arrow Z, and causes the toner to be carried on the developing sleeve 40.

The toner carried on the developing sleeve 40 comes to the position of the developing blade 44 with the rotation of the developing sleeve 40, and the developing blade 44 regulates the amount of toner to thereby form a predetermined thin toner layer, and a desired amount of charging charge is imparted thereto. The toner made into a thin layer on the developing sleeve 40 is carried to a developing area in which the photosensitive drum 1 and the developing sleeve 40 are proximate to each other with the rotation of the developing sleeve 40, and in the developing area, the toner adheres to the electrostatic latent image formed on the surface of the photosensitive drum 1, by a developing bias applied from a voltage source, not shown, to the developing sleeve 40, to thereby develop the latent image. As the developing bias, use was made of a DC bias of −260V superimposed on an AC peak-to-peak voltage of 2 kV and an AC bias of an AC frequency of 3 kHz. The waveform of the developing bias is set so as to intersect with both of the value of the dark portion surface potential of the photosensitive drum 1 and the value of the light portion surface potential of the photosensitive drum 1, whereby an alternate electric field is formed between the developing sleeve 40 and the photosensitive drum 1. Between the developing sleeve 40 and the photosensitive drum 1, there is provided a gap in the developing area, and in this gap, the toner flies from the developing sleeve 40 to the drum 1 by the formed alternate electric field. In the present embodiment, the gap between the developing sleeve 40 and the photosensitive drum 1 is 280 μm.

The toner which has not contributed to the developing of the electrostatic latent image and is residual on the surface of the developing sleeve 40 is returned into the developing device with the rotation of the developing sleeve 40, and is stripped and collected from the developing sleeve 40 by the frictional contact portion thereof with the toner supplying roller 43. The collected toner is agitated and mixed with the remaining toner by the toner agitating mechanism 42.

<Method of Detachably Mounting the Process Cartridge on the Image Forming Apparatus Main Body>

Figure 6:
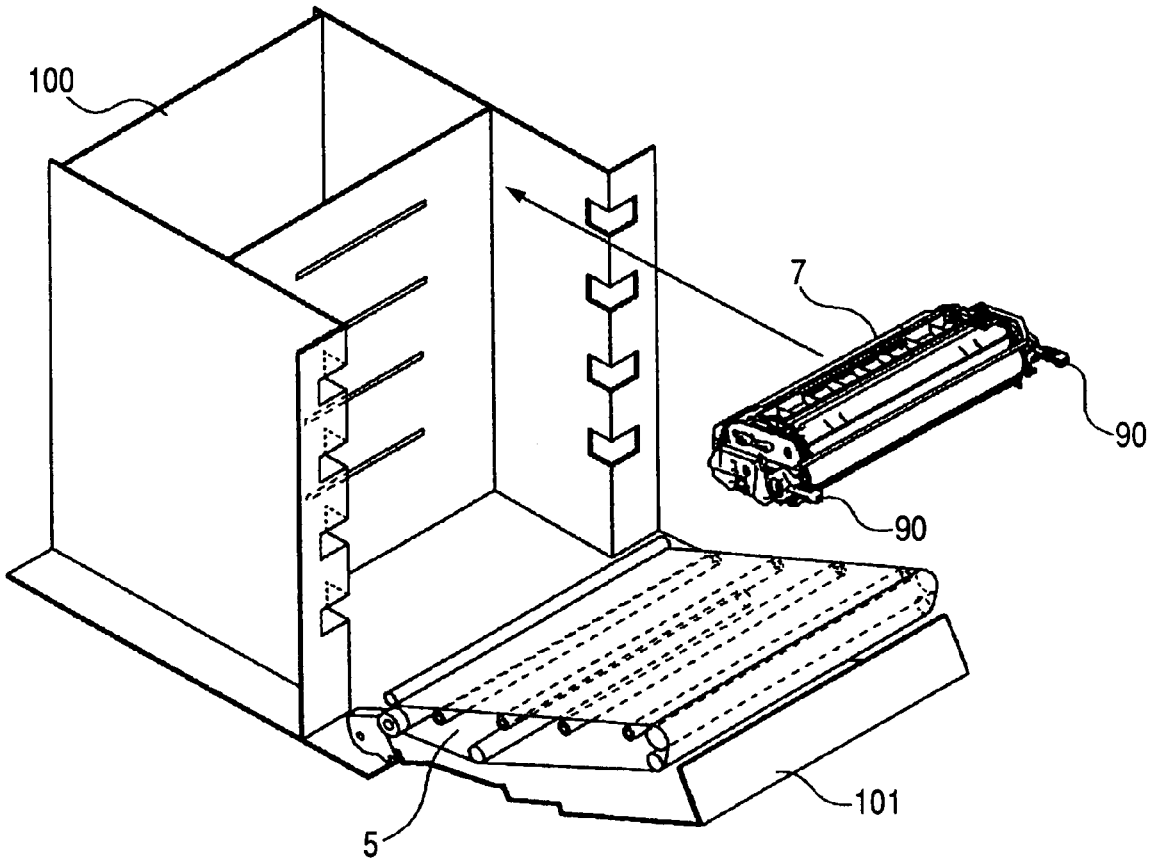
FIG. 6 is a schematic perspective view showing the time when the process cartridge is mounted on an image forming apparatus main body according to the present invention.

A method of detachably mounting the process cartridge 7 on the image forming apparatus main body 100 will now be described with reference to FIG. 6. As shown in FIG. 6, a front door 101 is provided on the image forming apparatus main body 100, and is provided for pivotal movement relative to the main body 100.

Also, the electrostatic transferring device 5 is pivotably provided at the back of the front door 101. With the front door 101 and the electrostatic transferring device 5 opened relative to the apparatus main body 100, the process cartridges 7 of the four colors become detachably mountable on the image forming apparatus main body 100. Handle members 90 are provided near the photosensitive drum supporting portions at the opposite end portions of the process cartridge 7, and protrude to the front door side of the main body during the mounting and dismounting of the cartridge.

The process cartridge 7 become detachably mountable on the image forming apparatus main body 100 by a guide rail portion (not shown) provided in the image forming apparatus main body 100 and an insertion guide portion (not shown) provided on the process cartridge 7 being engaged with each other.

<Developer Layer Regulating Member>

The construction of the developing blade which is a developer layer regulating member in the developing unit which is the developing apparatus and the surroundings thereof will now be described with reference to FIGS. 7 to 10 and 11A to 11C.

The developing blade 44 is provided with a regulating portion formed of an elastic material such as rubber or a thin metal for regulating the thickness of a layer of developer carried on the developing sleeve 40, and a regulating portion supporting member formed of a metal for supporting the regulating portion. In the present embodiment, a phosphor bronze plate which is a metal plate is used as the regulating portion.

The developing blade 44, near the longitudinal opposite end portions thereof, is fixed to the developing frame member 45 by screws 71 and 72 (FIGS. 7, 8A, 8B and 10). The regulating portion supporting member of the developing blade is a metal plate and it is difficult for the distortion thereof due to fixing to occur and therefore, it is desirable in positional accuracy to reliably fix it to the developing frame member by screws which are fastening members.

The developing frame member 45 is provided with a first flat surface 45*e* which is a flat surface parallel to the developing sleeve 40, positioning portions 45*c* and 45*d* provided protrudingly from the first flat surface 45*e*, a second flat surface 45*f* differing from the first flat surface 45*e*, and a positioning portion 45*b* provided protrudingly from the second flat surface 45*f*.

Figure 7:
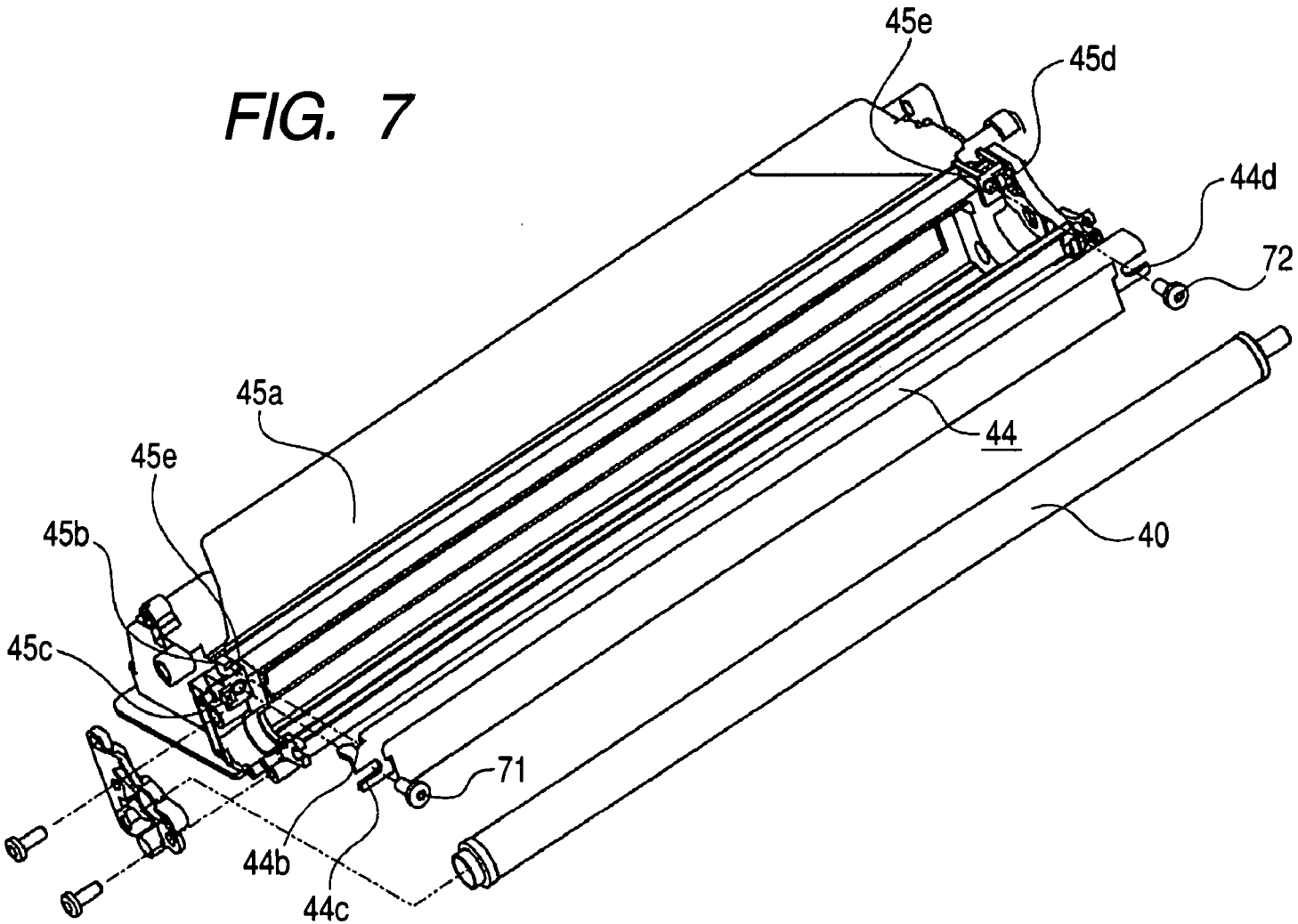
FIG. 7 is an exploded perspective view showing the process cartridge according to the present invention.
Figure 8A:
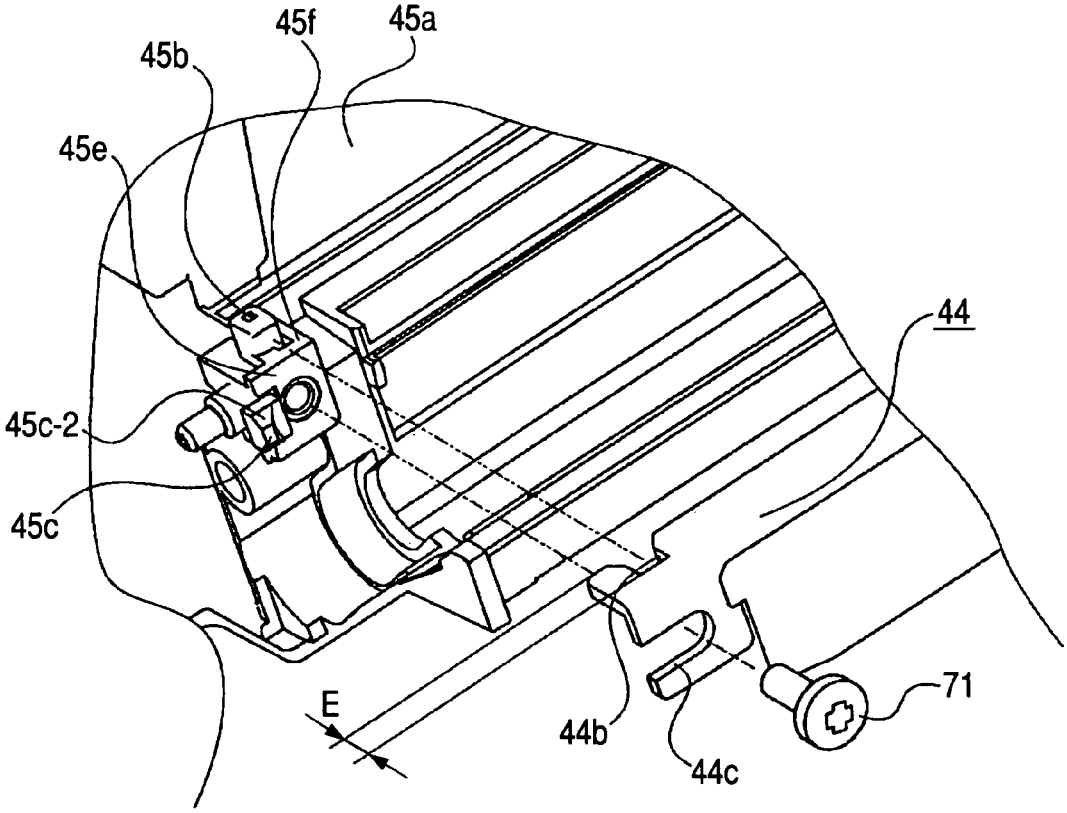
FIGS. 8A and 8B are exploded perspective views showing the process cartridge according to the present invention.
Figure 8B:
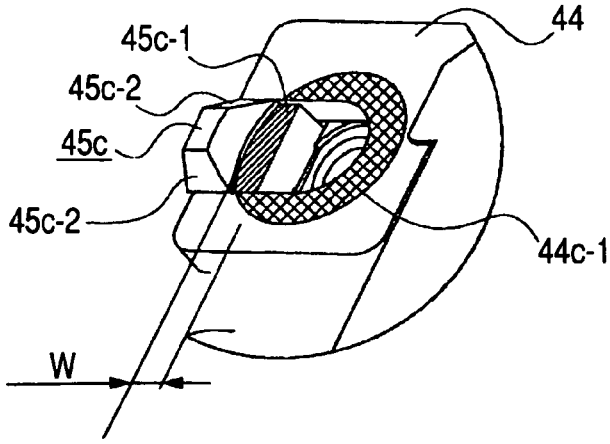
Figure 9A:
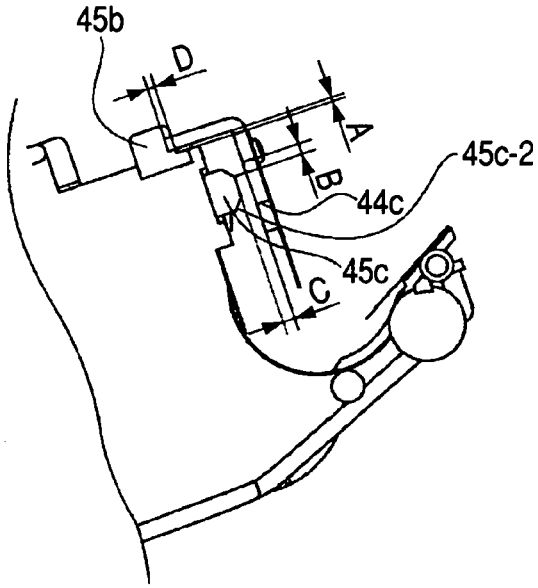
FIGS. 9A, 9B and 9C are assembly illustrations showing the process partridge according to the present invention.
Figure 9B:
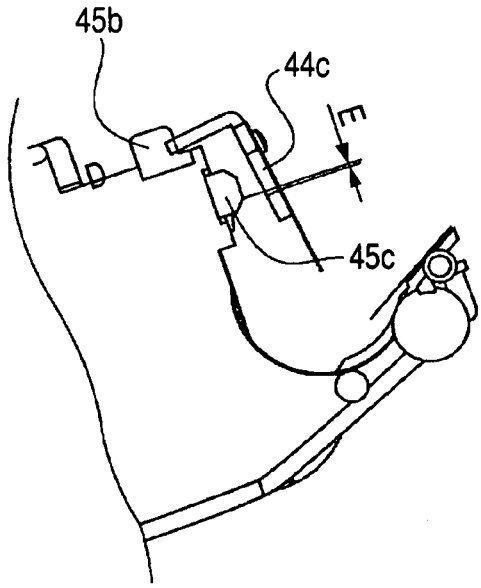
Figure 9C:
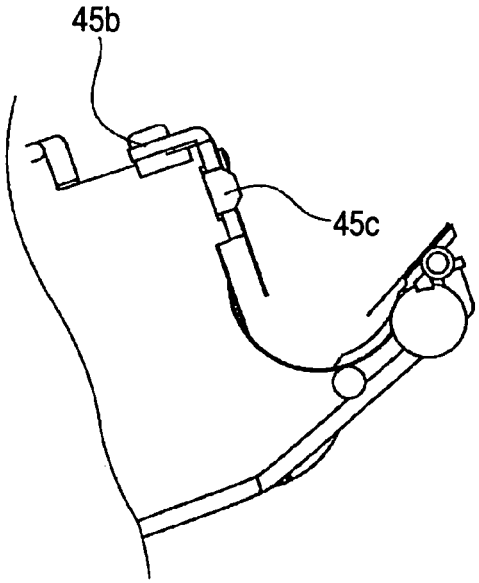
Figure 10:
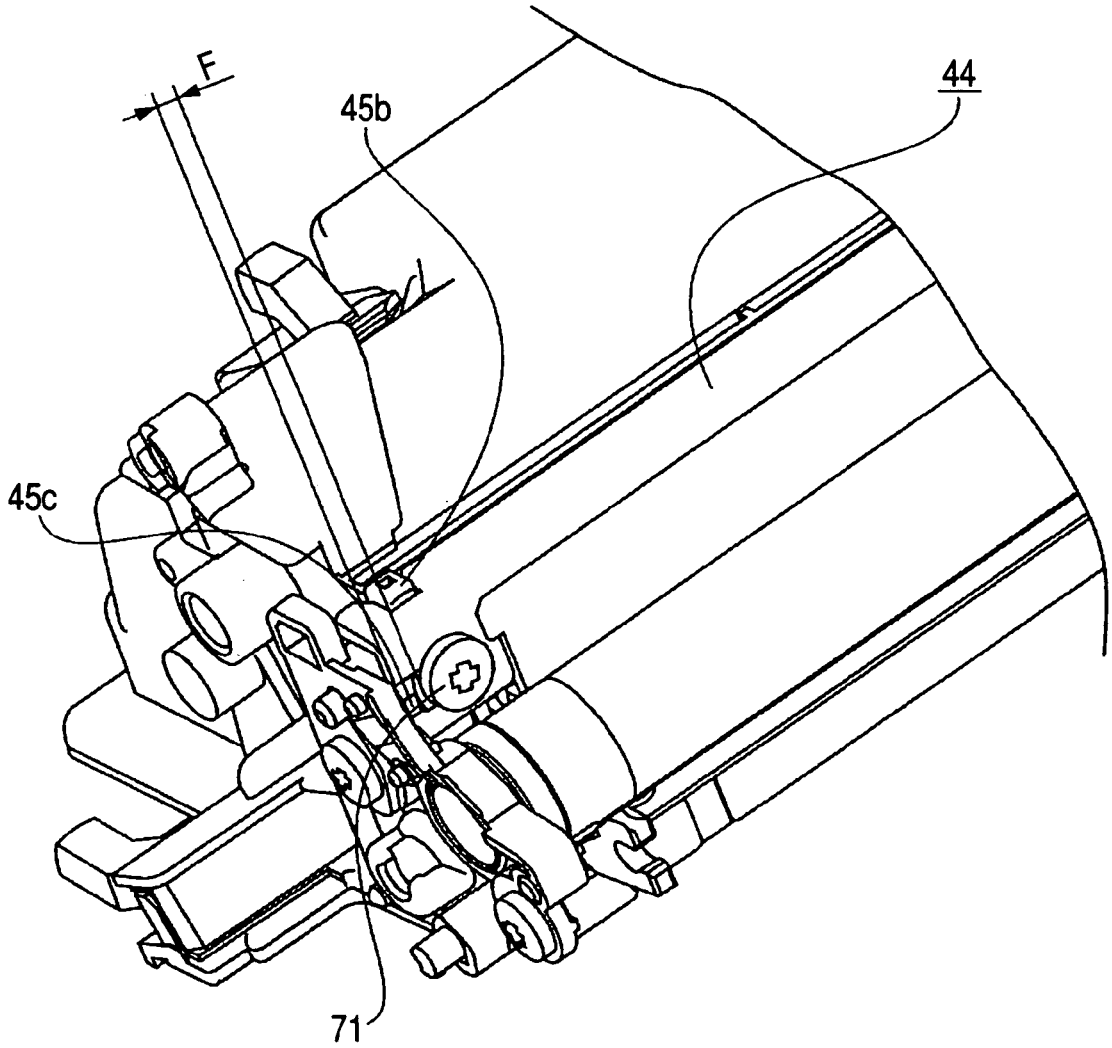
FIG. 10 is a perspective view showing the process cartridge according to the present invention.

As shown in FIGS. 7, 8 and 9, in the contact portion between the developing blade 44 and the developing sleeve 40, the position of the developing blade 44 relative to the tangential direction (a direction orthogonal to the longitudinal direction of the blade) of the developing sleeve 40 is determined by the positioning portions 45*c* and 45*d*, and the position of the developing blade 44 relative to the longitudinal direction of the developing sleeve 40 is determined by the positioning portion 45*b*.

The supporting member of the developing blade 44 is formed with U-shaped grooves 44*c* and 44*d* in the longitudinal end portions thereof, and in the present embodiment, a laterally U-shaped groove 44*b* is disposed in a surface orthogonal thereto.

Figure 11A:
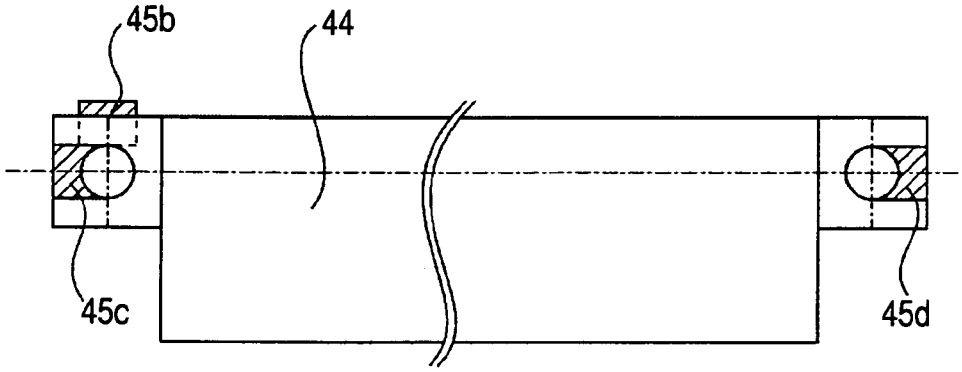
FIGS. 11A, 11B and 11C are illustrations of a developing blade.

By these positioning portions, the developing blade 44 is positioned relative to the developing frame member 45, as shown in FIG. 11A.

By adopting this construction, it becomes possible for the fixing screw 71 and the positioning portion 45*c* to become proximate to each other, and this leads to a construction leading to the downsizing of the apparatus.

Figure 11B:
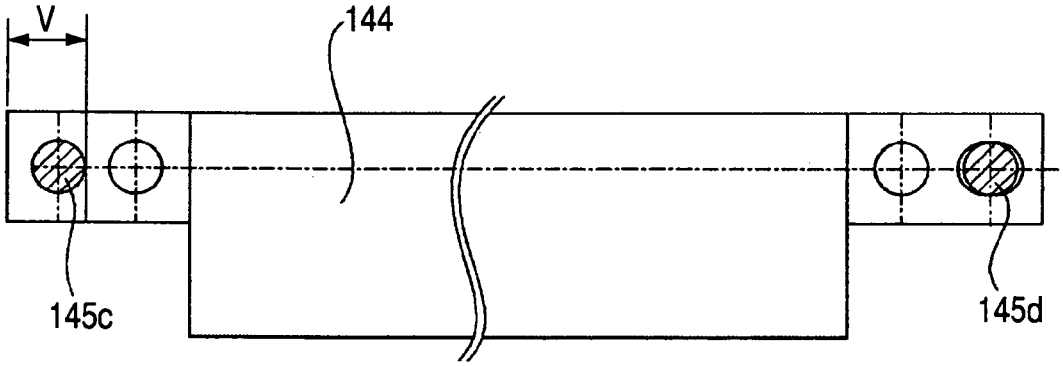
Figure 11C:
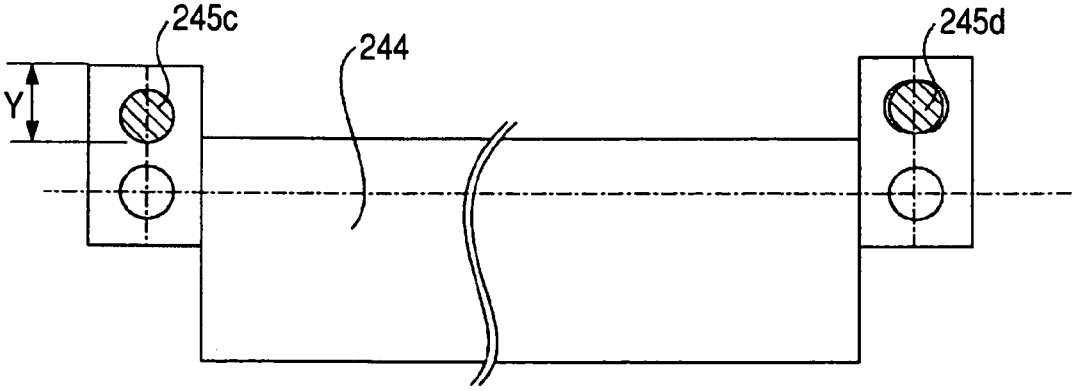

In contrast, a conventional popular positioning method is shown in FIGS. 11B and 11C. In a case where as shown in FIG. 11B, an attempt is made to position developing blades 144 and 244 by the round-shaped boss of the developing frame member, if for example, positioning bosses are disposed in the developing frame member as indicated at 145*c* and 145*d*, a space indicated by a width V will become necessary in a longitudinal end portion of the blade in FIG. 11B. Also, if as shown in FIG. 11C, for example positioning bosses are disposed in the developing frame member as indicated at 245*c* and 245*d*, a space indicated by Y will become necessary in an end portion in the width direction (a direction orthogonal to the longitudinal direction) of the blade in FIG. 11C.

As shown in FIG. 11A, however, the construction of the developing blade 44 in the present embodiment is adopted, whereby these spaces become unnecessary and the downsizing of the apparatus becomes possible.

Description will now be made of a method of assembling the developing apparatus.

In the present embodiment, as shown in FIG. 8B, slopes 45*c*-2 are provided on the positioning portion 45*c* of the developing frame member, and these are set so that as shown in FIG. 9B, during assembly, the developing blade 44, even if somewhat inclined, may be easily inserted owing to the presence of a gap E. Also, the assembly of the developing blade to the developing frame member is set so that the fitting of the positioning portion 45*b* and the laterally U-shaped groove 44*b* may begin earlier, and then the fitting of the positioning portion 45*c* and the U-shaped groove 44*c* may be completed. That is, the length E indicated in FIG. 8A is set so that as shown in FIG. 9A, a gap C may exist even if a fitting length D occurs. Also, during assembly, as shown in FIG. 9A, a gap A is provided between the developing blade 44 and the developing frame member 45, and the relation between the gap A and a gap B between the positioning portion 45*c* and the portion 44*c* indicated in FIG. 9A is rendered into A<B, whereby even if A=0 during assembly, the slopes 45*c*-2 are provided so that the portions 45*c* and 44*c* may easily fit to each other.

Description will now be made of the relation between the screws and the positioning portions.

The developing blade, near the longitudinal opposite end portions thereof, has its supporting member for supporting the regulating portion fixed to the developing frame member by the screws which are fastening members. The positioning portion 45*c* has areas 44*c*-1 and 45*c*-1 hidden by screwing (FIG. 8B). These areas are constituted by a surface 45*c*-1 lower by a step in height than the surrounding surface so that the bearing surfaces of the screws may be fastened in contact with the developing blade 44. By adopting such a construction, the screws are fastened in the area 44*c*-1, and the fixing of the developing blade 44 is effected properly and accurately. Also, the presence of the surface 45*c*-1 makes it possible to secure the fitting length (longitudinal direction) of 45*c* and 44*c* more greatly by an amount indicated by W.

<Flight Developer Regulating Member>

Description will now be made of a regulating member for regulating the reciprocal moving area of the developer in the developing area (hereinafter referred to as the flight developer regulating member in order to clearly distinguish from the developer layer regulating member).

Figure 1A:
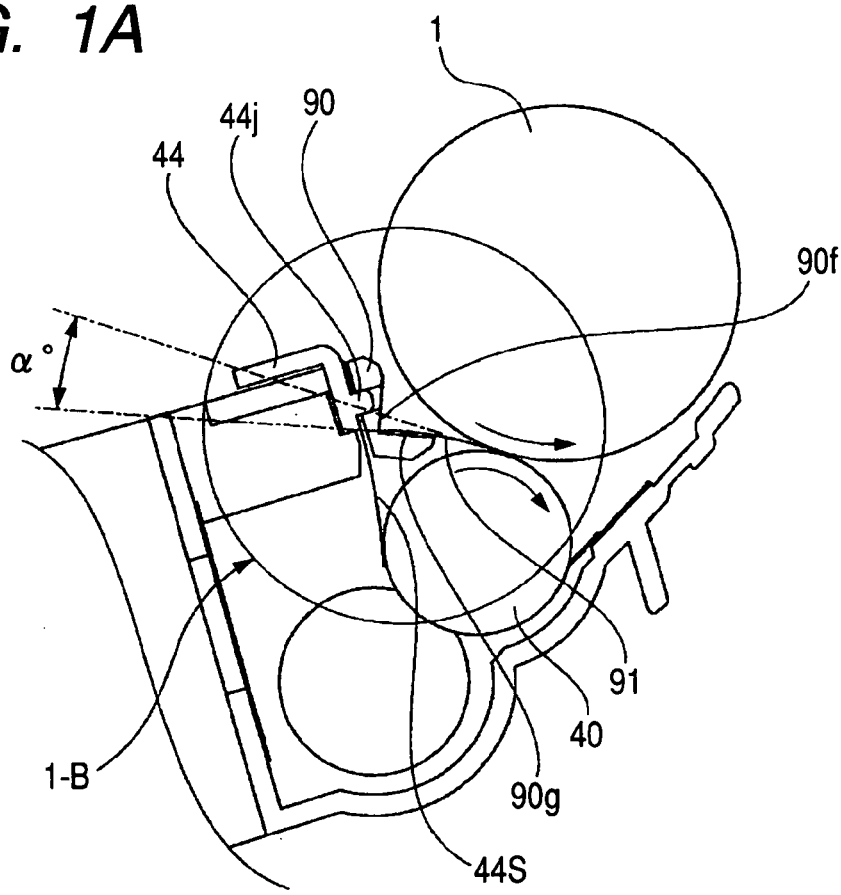
FIGS. 1A and 1B are cross-sectional views showing an example of a developing apparatus according to the present invention.
Figure 1B:
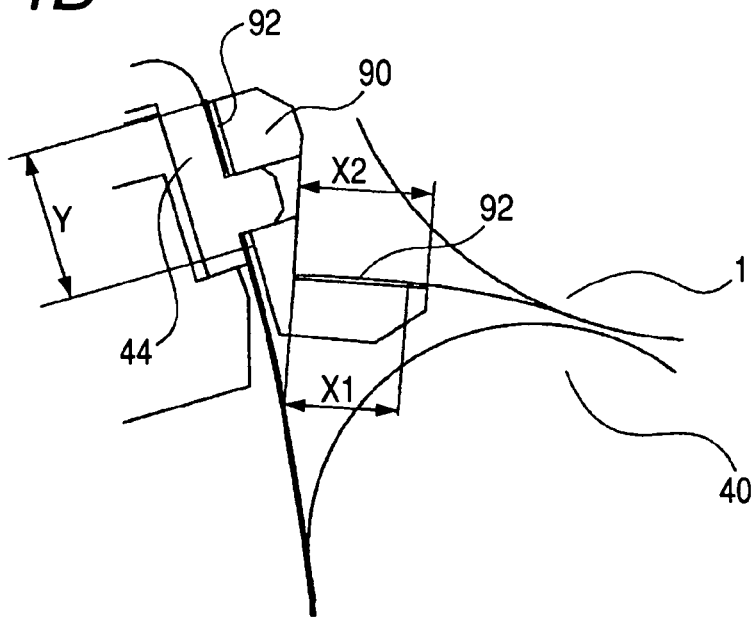

The flight developer regulating member in the present embodiment is shown in FIGS. 1A, 1B, 2 and 3. FIG. 1B is an enlarged view of the portion 1-B of FIG. 1A.

The flight developer regulating member is provided with a flight developer regulating sheet 91 for regulating an area in which the developer flies, and a regulating sheet supporting member 90 for supporting this regulating sheet 91. The regulating sheet 91 is fixed to the developing blade 44 which is a developer layer regulating member through the regulating sheet supporting member 90. As shown in FIGS. 1A and 1B, a space defined by the developing blade, the developing sleeve and the photosensitive drum is narrow, and it becomes spatially advantageous to downsizing to provide the flight developer regulating member in this space and therefore, it is better to mount the flight developer regulating member on the developing blade than to mount it on the developing frame member. Also, the upper side of the developing frame member is an optical path for applying light for image forming, and an attempt to mount the flight developer regulating member on the developing frame member hinders the optical path. However, mounting the flight developer regulating member on the developing blade does not hinder the space on the upper side of the developing frame member and is therefore advantageous.

As the flight developer regulating sheet 91, use is made, for example, of an insulative flexible resin sheet, which is an insulative or electrically floating member.

The flight developer regulating sheet 91 regulates a portion of the developing area upstream of the drum 1 with respect to the rotational direction thereof. When the rotation of the drum 1 is stopped and the developing operation is performed after such a latent image as assumes maximum image density has been formed on the drum, in a case where the regulating sheet 91 is provided, the toner adhering range in the rotational direction of the drum 1 becomes small as compared with a case where the regulating sheet 91 is not provided. As described above, the flight developer regulating sheet 91 is provided at such a position as regulates a portion of the developing area. The regulating sheet 91 is provided so as to contact with the photosensitive drum 1 and not to contact with the developer carried on the developing sleeve. The regulating sheet 91 is inserted into the narrow gap between the photosensitive member and the developing sleeve and therefore, the positional accuracy thereof becomes important.

The free end of the flight developer regulating sheet 91 is inserted into the upstream side in the developing area with respect to the direction of movement of the photosensitive drum 1, whereby such a phenomenon as sweeping-together in which density becomes high only in the trailing edge of an image such as a solid image (maximum density image) can be suppressed. The phenomenon of this sweeping-together is also described in U.S. 2005-0008401 A, but will hereinafter be described.

Sweeping-together is the phenomenon that much toner gathers on the trailing edge of an image. When an oscillating electric field is formed between the photosensitive drum and the developing sleeve by a developing bias, a barrel-shaped electric field is produced between the photosensitive drum and the developing sleeve in the developing area because the two are of an arcuate shape. Thereupon, the toner adhering to the surface of the developing sleeve reciprocally moves between the photosensitive drum and the developing sleeve along an electric line of force formed by the electric field and therefore, moves toward the outside of the most proximate point between the photosensitive drum and the developing sleeve. When the toner reciprocally moves, the photosensitive drum is being rotated and therefore, the toner is gathered toward the upstream side of the photosensitive drum. That is, when an AC bias is applied, the toner in the developing area always comes to have a speed component moving toward the upstream side outside the developing area. Thereby the phenomenon of sweeping-together occurs.

In a construction wherein an electrode is provided on the flight developer regulating sheet to thereby effect the supply of electric power, a strong electrostatic force comes to work between the electrode and the developing sleeve, and together with the vibration of the flight developer regulating sheet, an increase in a developing sound is great, and chatter is liable to occur in the portion of contact with the photosensitive drum and the portion of contact with the developing sleeve. When chatter occurs, the developer goes round onto that surface of the flight developer regulating sheet which is opposed to the photosensitive drum, and the sweeping-together image preventing effect decreases, and this is not preferable. Therefore, as in the present embodiment, no electrode is provided on the flight developer regulating sheet. Or even if an electrode is present, a construction in which it does not supply electric power and it is electrically floated is more preferable.

The supporting member 90 is positioned by positioning bosses 44*j* provided on the portions of the developing blade 44 which are near the longitudinal opposite end portions of the supporting member, and the contact between the two is effected on that surface of the developing sleeve 40 which contacts with the developing blade. As another embodiment, instead of providing the positioning bosses 44*j*, the position of the supporting member 90 may be determined by the use of a jig (not shown) and the supporting member may be attached to the developing sleeve 40. In this case, if the reference of the jig is made coincident with the reference position (not shown) of the developing frame member, positioning can be effected accurately. In the present embodiment, a two-side adhesive coated tape 92 is used for a fixing method, but an adhesive agent or a screw is usable. However, that portion of the flight developer regulating member which is fixed to the developing blade and the photosensitive member are proximate to each other and therefore, the use of the adhesive agent is more advantageous than using the screw for fixing. This is because the use of the screw is spatially disadvantageous since the head portion of the screw protrudes, and the proximity of the head portion of the screw to the photosensitive member may sometimes disturb the latent image. The space defined by the developing blade and the photosensitive member is originally narrow and therefore, in a case where the flight developer regulating member is mounted on the developing blade, it is more preferable to use the adhesive agent than to use the screw.

In a case where a two-side adhesive coated tape or an adhesive agent are used for fixing, in order to prevent the inclination of the supporting member 90, the supporting member must be attached to a range within an area Y indicated in FIG. 1B so as to avoid a position at which the thin-walled portion (phosphor bronze in the present embodiment) of the developing blade 44 begins to flex when the developing roller 40 is mounted.

Also, when the photosensitive drum 1 has been mounted, in order to prevent the supporting member 90 and the regulating sheet 91 from sandwiching the two-side adhesive coated tape at the corners thereof, and the fore end position thereof becoming irregular even if the flight developer regulating sheet 91 contacts with the photosensitive drum 1, whereby the flight developer regulating sheet 91 is flexed, the width X1 of the two-side adhesive coated tape is made smaller than the width X2 of the flat portion of the supporting member, as shown in FIG. 1B, to thereby achieve the stabilization of the fore end position.

Figure 2:
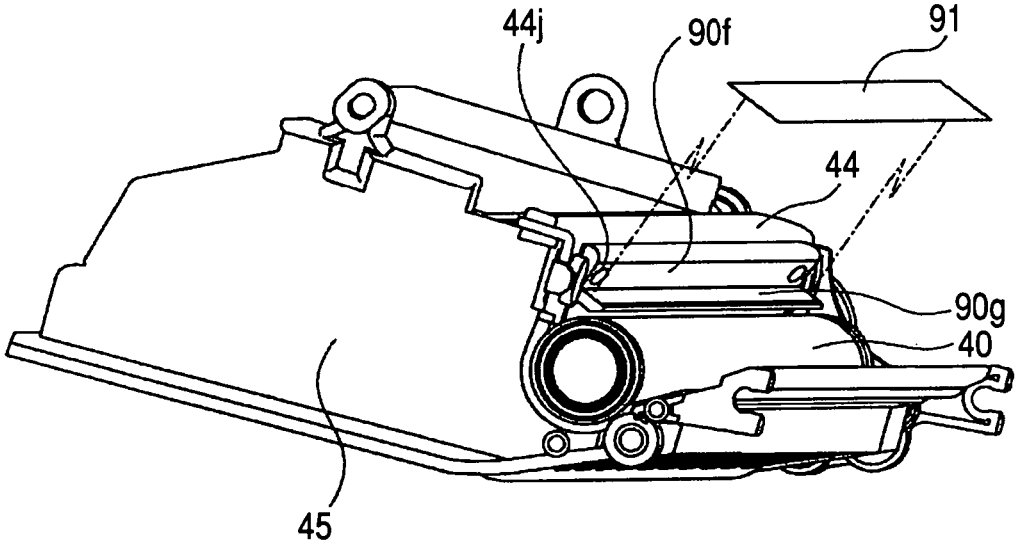
FIG. 2 is a perspective view showing a method of assembling the developing apparatus according to the present invention.

Also, as shown in FIGS. 1A and 2, the flight developer regulating sheet 91 is positioned by being rammed against a highly accurate surface 90*f* provided on the supporting member 90. The fore end (free end side) of the regulating sheet is brought into contact with the photosensitive drum, and it is in such a positional relation that it enters to the order of 1 mm from the surface of a virtual photosensitive drum in a state in which the photosensitive drum has been removed.

By doing so, there is the effect that the supporting member 90 and the developing blade 44 can obtain accurate and stable positions.

In the present embodiment, polyethylene terephthalate resin is selected as the flight developer regulating sheet 91. Also, polystyrene resin is used for the supporting member 90, and an aperture through which the attached surface of the developing blade 44 and the positioning bosses 44*j* fit to each other, and a supporting surface 90*g* for supporting the regulating sheet 91 are highly accurately molded by injection molding. This is because a developing bias is applied to the developing blade 44 and an electrically insulative material is used as the material of the flight developer regulating sheet 91 so that the developing bias may not leak to the photosensitive drum 1.

The flight developer regulating sheet 91, as shown in FIG. 1A, is mounted at an angle α with respect to a line (indicated as the tangent of the photosensitive drum in FIG. 1A) orthogonal to a line passing through the center of rotation of the photosensitive drum 1 which is an image bearing member and the center of rotation of the developing sleeve 40 which is a developer carrying member. This means that an optimum angle is selected to prevent the flight developer regulating sheet 91 from vibrating and producing a noise during development. The angle α is such that on the aforementioned orthogonal line (tangent), with a line upstream of the line passing through the aforementioned centers of rotation with respect to the rotational direction of the photosensitive drum as the reference, a direction pivotally moving to the developing sleeve side is defined as plus, and a direction pivotally moving to the photosensitive drum side is defined as minus.

Here, in the case of α=0° (the case of being orthogonal), the noise is highest, and the thinner is the flight developer regulating sheet 91, the higher is the noise. In the present embodiment, in order to avoid this, the thickness of the flight developer regulating sheet 91 is selected to 20 μm to 200 μm, and the angle α is selected to a range of +1° to 45° to thereby obtain the effect of reducing the noise. A greater thickness is advantageous against the noise, but increases the probability with which the photosensitive drum is injured (Table 1). Accordingly, the aforementioned thickness is selected within a range which will not frictionally injure the photosensitive drum, and further, in order that burr formed by the severing of the flight developer regulating sheet 91 during manufacture may not contact with the photosensitive drum, the sheet 91 is attached so that of the sides of the flight developer regulating sheet 91, that side on which the burr is formed may be the developing roller side. Also, the aforementioned angle is determined in view of the limitation of the space and a reduction in the noise.

TABLE 1

| | | | |
|---|---|---|---|
| | Relation between Noise and Thickness | | |
| thickness | small | → | great |
| noise | great | | small |
| | Relation between Angle and Noise | | |
| angle | +45° | → | 0° |
| noise | small | → | great |

When the angle α assumes the negative direction (−α), the supporting member 90 becomes too proximate to the photosensitive drum 1, and this has been unsuitable from the viewpoint of space.

A fixing end portion which is a first portion (first side) of the supporting member for the flight developer regulating member is attached to the blade for regulating the developer layer on the developer carrying member, whereby an end portion which is a second portion (second side) of the supporting member for the flight developer regulating member is provided upstream of the line passing through the center of rotation of the image bearing member and the center of rotation of the developer carrying member with respect to the rotational direction of the developer carrying member (or the image bearing member), i.e., on the left side in the plane of the drawing sheet of FIG. 1A. In the present embodiment, the aforedescribed first portion is that portion of the supporting member 90 which is mounted on the developing blade, and the aforedescribed second portion is that portion of the supporting member 90 which supports the regulating sheet 91.

A method of assembling the flight developer regulating member will now be described with reference to FIG. 2.

After the developing blade 44 has been mounted on the developing frame member 45, the developing roller 40 is mounted on the developing frame member 45. Thereafter, the supporting member 90 is attached to a regulating portion surface 44*s* by means of a two-side adhesive coated tape 92, and lastly the flight developer regulating sheet 91 is rammed against the ramming portion 90*f* of the supporting member 90 and is attached to the supporting surface 90*g* thereof. By doing so, it is possible for a worker to assemble accurately even when he manually assembles, and there is the effect that manufacture becomes possible at a low cost. In the present embodiment, as the regulating portion, use is made of a phosphor bronze plate which is a metal plate.

Also, as another embodiment, after the flight developer regulating sheet 91 has been attached to the supporting member 90, the supporting member 90 may be attached to the regulating portion surface 44*s* of the developing blade 44 by means of a two-side adhesive coated tape. Particularly in this case, the regulating sheet 91 and the supporting member 90 can be made into a unit, and the attachment of the regulating sheet 91 and the supporting member 90 can be effected easily. Also, in the present embodiment, in order to prevent the wrinkling or waving of the regulating sheet 91, when the regulating sheet is to be attached to the supporting member 90, the supporting member 90 is warped so that tension may be applied to the regulating sheet 91 after attached. If with the regulating sheet 91 attached to the supporting member 90, the free end side of the regulating sheet 91 is accurately cut relative to the reference of the supporting member 90, whereafter the supporting member is attached to the regulating portion surface 44*s* of the developing blade 44, the positional accuracy of the fore end will be good. Also, the regulating sheet 91 and the supporting member 90 are formed of resin and are thin and therefore, are liable to be distorted and thus, when the supporting member 90 is to be fixed to the blade, it is preferable to secure it not by screwing, but by a two-side adhesive coated tape or the like. This is because if screwing is used, the vicinity of the fixed portion becomes liable to be distorted. Thus fixing the flight developer regulating member to the developing blade by adhesively securing is preferable for the purpose of improving the positional accuracy of the flight developer regulating member in the developing area.

Figure 12:
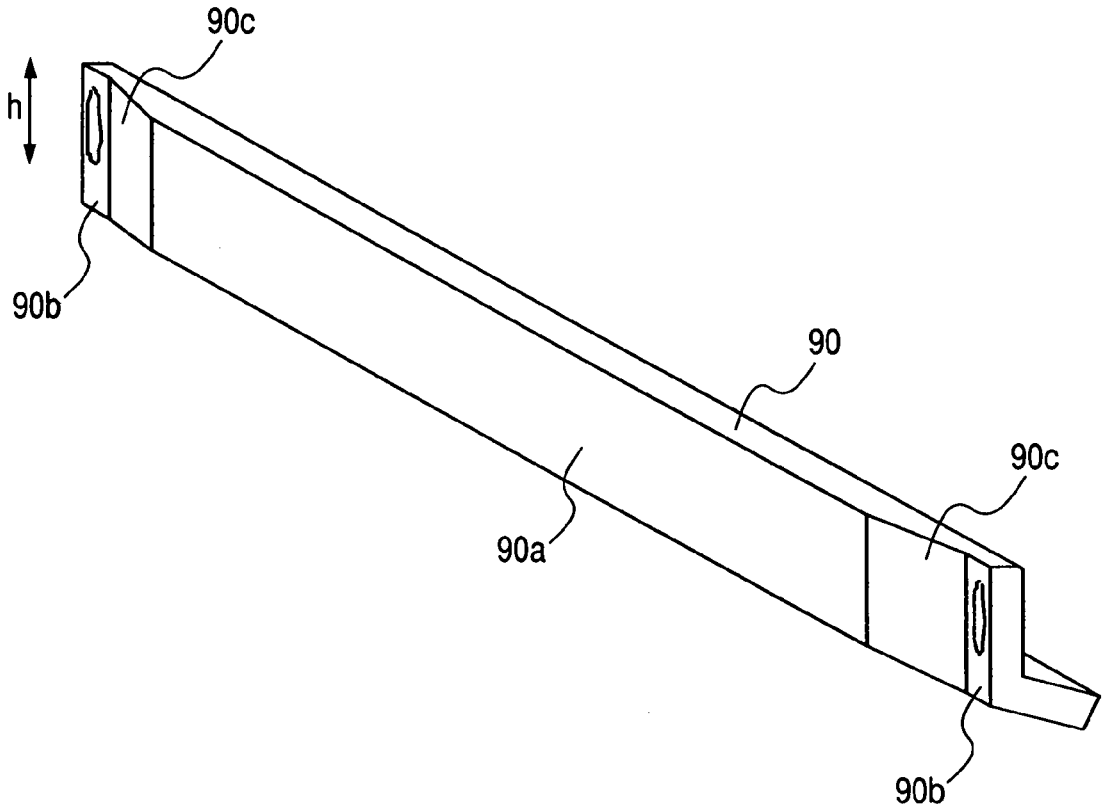
FIG. 12 is an illustration of a supporting member which supports a flight developer regulating sheet.

Also, FIG. 12 shows another embodiment of the supporting member 90. When the regulating sheet 91 is to be attached to the supporting member 90, tension is applied to the regulating sheet 91 as described above, but near the longitudinal end portions of the regulating sheet 91, tension is not sufficiently applied but wrinkles or waving may sometimes occur and therefore, in order to prevent this, it is preferable to construct the supporting member 90 as follows.

The fixed surface of the supporting member 90 is provided with a first fixed surface 90*a* fixed to the developing blade, second fixed surfaces 90*b* having a level difference relative to the first fixed surface 90*a* and fixed to the developing blade, and slopes 90*c* which are fixed surfaces linking the first fixed surface 90*a* and the second fixed surfaces 90*b* together. In FIG. 12, apertures formed in the second fixed surfaces 90*b* are apertures into which the positioning bosses 44*j* are fitted.

After the regulating sheet 91 has been attached to the supporting member 90 and tension has been applied thereto, the supporting member 90 is mounted on the developing blade 44 by the first fixed surface 90*a*, the slopes 90*c* and the second fixed surfaces 90*b* opposed to the surface of the developing blade 44, through a two-side adhesive coated tape. The second fixed surfaces 90*b* formed on the opposite end portions of the supporting member 90 are formed lower by a step than the first fixed surface 90*a*, and the first fixed surface 90*a* and the second fixed surfaces 90*b* are smoothly connected together by the slopes 90*c*. Specifically, the second fixed surfaces 90*b* are formed lower by 0.2 mm than the first fixed surface 90*a*. In other words, the first fixed surface 90*a* is provided more protrudingly than the second fixed surfaces 90*b*. By adopting such a construction, when the two-side adhesive coated tape is attached to the first fixed surface 90*a*, the slopes 90*c* and the second fixed surfaces 90*b*, and the supporting member 90 is brought into close contact with the surface of the developing blade, the opposite end portions of the supporting member 90 are arcuately warped and as the result, tension is applied to the end portions of the flight developer regulating sheet 91, whereby the wrinkling and waving of the end portions of the flight developer regulating sheet 91 can be prevented from occurring. That is, the wrinkling and waving caused by the regulating sheet 91 being flexible and very thin can be prevented. When such wrinkling and waving occur, the regulating sheet 91 may contact with the developing sleeve to thereby disturb the toner layer carried on the developing sleeve. Particularly, the gap between the photosensitive member and the developing sleeve is as narrow as 280 μm and therefore, the positional accuracy of the regulating sheet 91 inserted between the photosensitive member and the developing sleeve is important. In the present embodiment, in FIG. 12, in the longitudinal direction of the supporting member 90, the length of the entire supporting member is 225.4 mm, the length of each of the second fixed surfaces 90*b* is 19.6 mm, and the sum of the length of the second fixed surfaces 90*b* and the length of the slopes 90*c* is 24.6 mm. Also, in FIG. 12, the width of the supporting member 90 in a direction h is 4.7 mm. It is also preferable to make the first fixed surface, the slopes and the second fixed surfaces into a curved surface as a whole to thereby flex the supporting member 90 when it is attached to the developing blade.

While in the present embodiment, the supporting member 90 is attached to the regulating portion 44*s* of the blade, instead it is also possible to attach the supporting member 90 to the supporting member of the blade.

Also, while in the above-described embodiment, the developing sleeve is used as the developer carrying member, instead it is also possible to use a developing roller provided with a mandrel and rubber provided on the mandrel.

Further, as the image bearing member, a dielectric member can also be used instead of the photosensitive member, and the shape thereof is not limited to a drum shape, but use can also be made of a belt-shaped member.

This application claims priority from Japanese Patent Application Nos. 2004-104633 filed on Mar. 31, 2004 and 2005-071278 filed on Mar. 14, 2005, which are hereby incorporated by reference herein.

What is claimed is:

1. A developing apparatus comprising:

a developer carrying member provided in opposed relationship with an image bearing member, and carrying a developer thereon, wherein in an opposed portion between said image bearing member and said developer carrying member, an oscillating electric field is formed between said image bearing member and said developer carrying member, and the developer is caused to fly from said developer carrying member to said image bearing member;

a developer layer regulating member for regulating a layer of developer on said developer carrying member; and a flight developer regulating member for regulating an area in which the developer flies in said opposed portion, said flight developer regulating member being mounted on said developer layer regulating member, wherein said developer layer regulating member is provided with a regulating portion for regulating the layer of developer, and a regulating portion supporting member for supporting said regulating portion, and said flight developer regulating member is mounted on said regulating portion.

2. A developing apparatus according to claim 1, wherein said regulating portion is a metal plate.

3. A developing apparatus according to claim 1, wherein said flight developer regulating member is mounted at a predetermined angle with respect to a line orthogonal to a line passing through a center of rotation of said developer carrying member and a center of rotation of said image bearing member.

4. A developing apparatus according to claim 1, wherein said flight developer regulating member is an insulative or electrically floating member.

5. A developing apparatus according to claim 1, wherein said flight developer regulating member is provided in contact with said image bearing member.

6. A developing apparatus according to claim 5, wherein said flight developer regulating member is provided in spaced apart relationship with the developer carried on said developer carrying member.

7. A developing apparatus according to claim 1, wherein said flight developer regulating member is provided with a sheet for regulating an area in which the developer flies, and a tensile force is imparted to the sheet.

8. A developing apparatus according to claim 7, wherein said flight developer regulating member is provided with a sheet supporting member for supporting said sheet, and a tensile force is imparted to the sheet by said sheet supporting member.

9. A developing apparatus according to claim 8, wherein said supporting member is provided with a first fixed surface fixed to said developer layer regulating member, and a second fixed surface provided outwardly of said first fixed surface in a longitudinal direction of said supporting member, and said first fixed surface is provided more protrudingly than said second fixed surface.

10. A developing apparatus according to claim 1, wherein said flight developer regulating member is mounted on said developer layer regulating member by being adhesively secured thereto.

11. A developing apparatus according to claim 1, further comprising a developing frame member, which contains the developer, wherein said developer layer regulating member is fixed to said developing frame member by a fastening member, and said flight developer regulating member is mounted on said developer layer regulating member by being adhesively secured thereto.

12. A developing apparatus according to claim 1, wherein said flight developer regulating member is provided with a sheet for regulating an area in which the developer flies, and a sheet supporting member for supporting said sheet, and said sheet supporting member is mounted on said regulating portion.

13. A developing apparatus according to claim 1, wherein said developer is a nonmagnetic mono-component developer.

14. A developing apparatus according to claim 1, wherein said developing apparatus, together with said image bearing member, is provided in a process cartridge detachably mountable on a main body of an image forming apparatus.

15. A flight developer regulating member for regulating an area in which a developer flies in an opposed portion between an image bearing member and a developer carrying member, said flight developer regulating member comprising:

a sheet for regulating the area in which the developer flies; and a sheet supporting member for supporting said sheet, said sheet supporting member being provided with a first portion mounted on a developer layer regulating member for regulating a layer of developer on said developer carrying member, and a second portion provided upstream with respect to a rotational direction of said developer carrying member in said opposed portion, and for supporting said sheet, wherein the developer layer regulating member is provided with a regulating portion for regulating the layer of developer, and a regulating portion supporting member for supporting said regulating portion, and said first portion is mounted on said regulating portion.

16. A flight developer regulating member according to claim 15, wherein said first and second portions are opposite end portions of said sheet supporting member.

17. A flight developer regulating member according to claim 15, wherein said flight developer regulating member is an insulative or electrically floating member.

18. A flight developer regulating member according to claim 15, wherein said developer is a nonmagnetic mono-component developer.

19. A method of assembling a developing apparatus having a developer carrying member provided in opposed relationship with an image bearing member, and carrying a developer thereon, a developer layer regulating member for regulating a layer of developer on said developer carrying member, and a developing container containing the developer therein, wherein said developer layer regulating member is provided with a regulating portion for regulating the layer of developer, and a regulating portion supporting member for supporting said regulating portion, wherein in an opposed portion between said image bearing member and said developer carrying member, an oscillating electric field is formed between said image bearing member and said developer carrying member, and the developer is caused to fly from said developer carrying member to said image bearing member to thereby develop an electrostatic image formed on said image bearing member, said method comprising:

a first step of providing a flight developer regulating member for said developing apparatus, said flight developer regulating member regulating an area in which the developer flies in said opposed portion; and a second step of mounting said flight developer regulating member on said regulating portion after said developer carrying member has been mounted on said developing container.

20. A method according to claim 19, wherein said flight developer regulating member is provided with a sheet for regulating an area in which the developer flies, and a sheet supporting member for supporting said sheet, and said method comprises a step of mounting said sheet on said sheet supporting member prior to said second step.

* * * * *

UNITED STATES PATENT AND TRADEMARK OFFICE

CERTIFICATE OF CORRECTION

PATENT NO. : 7,224,926 B2
APPLICATION NO. : 11/091587
DATED : May 29, 2007
INVENTOR(S) : Shinjiro Toba et al.

It is certified that error appears in the above-identified patent and that said Letters Patent is hereby corrected as shown below:

COLUMN 2:
Line 5, “accurately” should read --accurate--.
Line 40, “partridge” should read --cartridge--.

COLUMN 3:
Line 5, “are” should read --is--.
Line 63, “of the shape” should read --in the shape--.

COLUMN 4:
Line 3, “have should” should read --has--.
Line 15, “drum” should read --drums--.

COLUMN 6:
Line 18, “is contact” should read --is in contact--.

COLUMN 7:
Line 44, “tridges” should read --tridge--; and “become” should read --becomes--.
Line 50, “become” should read --becomes--.

COLUMN 9:
Line 19, “screwing” should read --screws--.

COLUMN 12:
Line 18, “selected to” should read --selected from--.
Line 19, “selected to” should read --selected from--.

Signed and Sealed this

Fifteenth Day of April, 2008

JON W. DUDAS
*Director of the United States Patent and Trademark Office*